United States Patent [19]

Campen

[11] Patent Number: 4,550,697

[45] Date of Patent: Nov. 5, 1985

[54] FLYWHEEL MOUNTING OF PERMANENT MAGNET GROUP

[75] Inventor: Kenneth W. Campen, Kiel, Wis.

[73] Assignee: Tecumseh Products Company, Tecumseh, Mich.

[21] Appl. No.: 563,690

[22] Filed: Dec. 20, 1983

[51] Int. Cl.[4] ..... F02P 1/00

[52] U.S. Cl. ..... 123/149 D; 123/149 R; 310/153; 310/156

[58] Field of Search ..... 123/149 D, 149 R; 310/70 R, 70 A, 152, 153, 156, 192

[56] References Cited

U.S. PATENT DOCUMENTS

| | | | |
|---|---|---|---|
| 2,538,534 | 1/1951 | Phelon | 310/153 |
| 2,568,479 | 9/1951 | Armstrong et al. | 310/153 |
| 2,756,356 | 7/1956 | Brownlee et al. | 310/153 |
| 3,298,336 | 1/1967 | Watkins . | |
| 3,334,254 | 8/1967 | Kober | 310/156 |
| 3,741,186 | 6/1973 | Doi et al. | 123/149 R |
| 3,809,040 | 5/1974 | Burson et al. . | |
| 3,828,212 | 8/1974 | Harkness et al. . | |
| 4,179,634 | 12/1979 | Burson . | |
| 4,219,752 | 8/1980 | Katou . | |
| 4,232,646 | 11/1980 | Asai . | |
| 4,358,727 | 11/1982 | Campen | 310/153 |
| 4,482,831 | 11/1984 | Notaras et al. | 310/156 |

*Primary Examiner*—Parshotam S. Lall

*Attorney, Agent, or Firm*—Albert L. Jeffers; Anthony Niewyk

[57] ABSTRACT

A scheme for mounting a permanent magnet group on the flywheel of a small internal combustion engine to provide the moving portion of an ignition system for such an engine is disclosed wherein the engine flywheel is formed of cast iron or similar ferromagnetic material and the magnet group is magnetically isolated from that flywheel so as to minimize short circuiting of the magnet group flux. A generally flat region of the flywheel receives a spacer or plate formed from aluminum or a similar substantially non-magnetic material such as zinc with that plate sandwiched between the flywheel and the magnet group by a pair of aluminum or similar non-magnetic material rivets passing through the flywheel plate and magnet group. The magnet group is held accurately and rigidly in position by upsetting the rivets in such a manner as to axially compress and therefore radially expand the rivet material so that the rivets tightly fill the respective apertures through which they pass. A further overlying plate of aluminum, zinc or other non-magnetic material may be included to retain the magnet group in position on the flywheel.

12 Claims, 2 Drawing Figures

FLYWHEEL MOUNTING OF PERMANENT MAGNET GROUP

BACKGROUND OF THE INVENTION

The present invention relates generally to techniques of fastening permanent magnet structures to ferromagnetic bodies in a manner to minimize flux short circuiting by the body while maintaining the permanent magnet structure rigidly in an accurately determined location. More particularly the present invention relates to such techniques where the body is a flywheel of a small internal combustion engine and the magnet structure is fastened near the outer periphery thereof as the moving portion of the engine ignition system.

Ignition systems for small internal combustion engines employing a permanent magnet rotating with the engine flywheel and a stator structure positioned either radially outwardly or radially inwardly of the magnet to have the flux patterns therein periodically changed by passage of the magnet are old and well known in the internal combustion engine art. Such ignition systems frequently employ two or three stator legs in close proximity to the path of the magnet and may rely on a capacitor discharge technique or solid state triggering schemes to induce a high voltage in a secondary winding of an ignition coil for ignition spark generating purposes. While forming no part of the present invention, it is contemplated that the pair of magnetic poles of the magnet group will sweep past an external E-shaped stator of an ignition system employing solid state techniques without mechanical breaker points of a type in current commercial use by applicant's assignee, however, it will be clear that the techniques of the present invention are applicable to a wide variety of ignition systems, battery charging schemes and other applications where it is desired to mount a permanent magnet on a ferromagnetic body in a magnetically isolated fashion.

Many small internal combustion engines employ a flywheel fabricated of cast aluminum and with such non-magnetic flywheel materials it has been a common technique to merely form a magnet group receiving pocket within the aluminum casting and then to fix the magnet group within that pocket by a pair of roll pins. U.S. Pat. No. 4,179,634 has addressed the problem of mounting such magnet group on a flywheel of either a non-magnetic or ferromagnetic nature and suggests a not altogether satisfactory solution to the magnetic flux short circuiting problems associated with a flywheel of a ferrous material. This U.S. patent suggests a nonferrous insert having a cavity within which the magnet group resides as illustrated in FIGS. 7 and 8 thereof. In those drawing figures, the magnet group is fastened within the nonferrous insert employing the standard technique of roll pins. The nonferrous pocket is in turn fastened by screws to the flywheel. As there is always some clearance between the screws and the non-threaded member through which those screws pass, the positioning of the nonferrous pocket is necessarily somewhat inaccurate in turn creating problems of variable air gap between the magnet structure on the flywheel and the fixed stator structure adjacent thereto. Also, typically, the region occupied by the magnet group detracts from the remaining annular region frequently occupied by air circulating fins for engine cooling purposes. Thus the more substantial angular space occupied by the nonferrous pocket in this patented arrangement detracts from the cooling of the engine. A still further drawback of this arrangement is of course the number and complexity of parts employed.

SUMMARY OF THE INVENTION

Among the several objects of the present invention may be noted the achievement of the aforementioned goals and avoidance of the above mentioned prior art defects; the provision of a method for fastening a permanent magnet group to a ferromagnetic body with substantial magnetic isolation of the magnet from the body; the reduction of angular obstruction in the air cooling fin array of an engine flywheel by a permanent magnet group; the accurate and rigid positioning of a permanent magnet group near the outer periphery of an engine flywheel; and the provision of a flywheel assembly for a small internal combustion engine with a permanent magnet structure supported near the outer periphery of a ferromagnetic flywheel. These as well as other objects and advantageous features of the present invention will be in part apparent and in part pointed out hereinafter.

In general, a permanent magnet group is affixed to a ferromagnetic body by providing a generally flat magnet group receiving region near the periphery of the body to receive first an apertured flat plate of substantially non-magnetic material and then the magnet group with rivets passing through the magnet group plate and body. The rivets are preferably of a solid non-magnetic material and radially expanded during the riveting process to tightly engage all three elements.

Also in general and in one form of the invention, a permanent magnet structure having flux transmitting pole shoes adjacent respective poles of a magnet is fastened to a ferromagnetic engine flywheel with a non-magnetic spacer positioned between the magnet structure and flywheel and with preferably two solid cylindrical fasteners of non-magnetic material extending through the magnet structure, spacer and flywheel in a radially expanded manner so as to tightly engage the respective elements and fix their relative positions.

BRIEF DESCRIPTION OF THE DRAWING

Corresponding reference characters indicate corresponding parts throughout the several views of the drawing.

Figure 1:
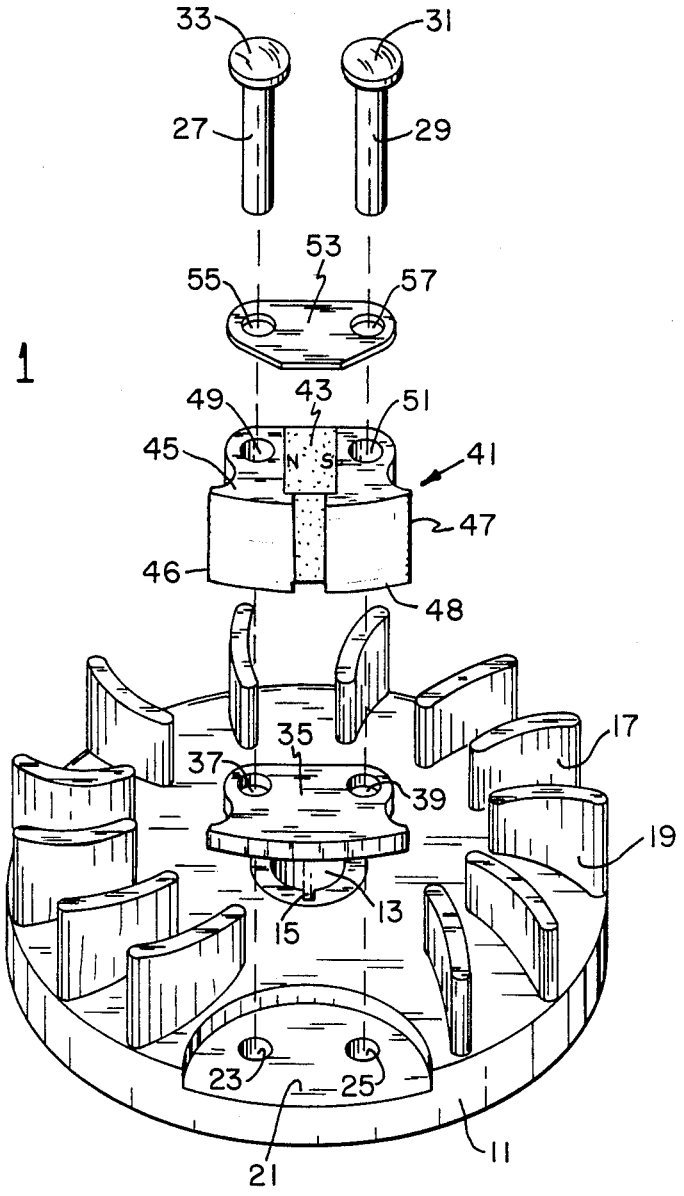
FIG. 1 is an exploded perspective view of the flywheel assembly of the present invention.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally the flywheel assembly is seen to include an engine flywheel 11 formed partially or totally of a ferromagnetic material such as cast iron, for example. The flywheel has typically a tapered central crankshaft receiving opening 13 containing a conventional keyway 15 for fastening the flywheel to an engine crankshaft for rotation therewith. The flywheel 11 also includes a series of air circulating fins such as 17 and 19 which, when the flywheel rotates about the axis of the crankshaft, tend to circulate air about the small internal combustion engine for cooling purposes. The fins are seen to occupy an annular region near the outer periphery of the flywheel 11 with that annular fin structure interrupted by a flat region 21 having apertures 23 and 25 for receiving solid non-magnetic rivets 27 and 29. Typically these rivets have preformed heads such as 31 and 33 and are of a non-magnetic material such as aluminum. The flat region 21 is adapted to receive a generally flat substantially non-magnetic spacer or plate such as the aluminum or zinc spacer 35 having rivet receiving openings 37 and 39 of like size, shape and spacing as the openings 23 and 25.

The magnet group 41 for the ignition system includes a permanent magnet 43 with a pair of pole shoes 45 and 47 positioned at the opposite poles of the permanent magnet 43. The pole shoes again include like rivet receiving apertures 49 and 51. A further non-magnetic plate such as the aluminum or zinc plate 53 with a still further like set of rivet receiving apertures 55 and 57 may be provided to overlay the magnet group 41 if desired.

Figure 2:
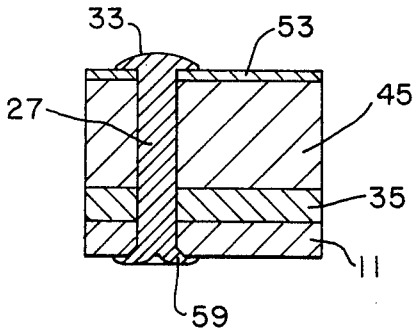
FIG. 2 is a view in cross section of a portion of the flywheel assembly of FIG. 1 in its assembled position.

The flywheel assembly method will be seen to be the juxtaposing of the flat permanent magnet structure receiving region 21 with the plate or spacer 35 and the magnet group 41 with the respective pairs of like spaced apertures in alignment and with the spacer 35 sandwiched between flywheel 11 and magnet structure 41 while the magnet structure 41 in turn is sandwiched between the spacer or plate 35 and the upper plate 53. The solid rivets 27 and 29 are passed through the aligned apertures and then upset as by axial compression to induce a correlative lateral expansion in the radial direction to tightly fill each of the aligned apertures as depicted in FIG. 2. Thus the rivet 27 has a second head 59 formed thereon by the upsetting process and further is expanded in a radial direction by this upsetting process to fill the respective apertures providing a press fit between the several parts and the rivet. Thus it will be seen that the flux transmitting pole shoes 45 and 47 are positioned at the periphery of the flywheel in a very secure manner and the solid fasteners or rivets 27 and 29 are the sole means interconnecting the flywheel 11 permanent magnet structure 41, spacer 35 and overlying flat plate 53. Some machining of the outer surfaces of 46 and 48 of the pole shoes 45 and 47 may be necessary for air gap setting.

From the foregoing it is now apparent that a novel flywheel assembly for a small internal combustion engine as well as a novel method of fastening a permanent magnet group to a ferromagnetic body with magnetic isolation between the body and magnet group have been disclosed meeting the objects and advantageous features set out herein before as well as others and that modifications as to the precise configurations, shapes, details and materials may be made by those having ordinary skill in the art without departing from the spirit of the invention or the scope thereof as set out by the claims which follow.

What is claimed is:

1. A flywheel assembly for a small internal combustion engine of the type supporting a permanent magnet structure near the flywheel outer periphery for cooperating with a fixed ignition assembly for inducing spark creating voltages in the ignition assembly as the magnet structure rotates past the ignition assembly and comprising:

a ferromagnetic flywheel;

a permanent magnet structure having a permanent magnet and a pair of flux transmitting pole shoes adjacent the respective poles of the permanent magnet, the poles of said magnet and the pole shoes circumferentially arranged near the periphery of said flywheel;

a substantially non-magnetic spacer axially positioned intermediate the flywheel and the permanent magnet structure for reducing flux leakage between the pole shoes by way of the flywheel; and a solid generally cylindrical fastener of substantially non-magnetic material passing through apertures in the magnet structure, spacer and flywheel, said fastener expanded radially in said apertures to tightly engage the magnet structure, spacer and flywheel and fix the relative positions thereof.

2. The flywheel assembly of claim 10 further comprising a second solid generally cylindrical fastener of non-magnetic material passing through apertures in the magnet structure, spacer and flywheel, said fastener expanded radially in said apertures to tightly engage and fix the relative positions of the magnet structure, spacer and flywheel.

3. The flywheel assembly of claim 2 wherein the solid fastener and second solid fastener pass through respective apertures in respective pole shoes of the permanent magnet structure.

4. The flywheel assembly of claim 2 wherein accurate location and retention of the magnet structure on the engine flywheel is accomplished solely by the solid fasteners.

5. The flywheel assembly of claim 3 further comprising a flat plate of substantially non-magnetic material overlying the magnet structure with the magnet structure sandwiched between the flat plate and the spacer, and with the fastener and second fastener passing additionally through the flat plate.

6. The flywheel assembly of claim 5 wherein the solid fastener and second solid fastener are the sole means interconnecting the flywheel, permanent magnet structure, flat plate and spacer.

7. The flywheel assembly of claim 5 wherein the spacer, flat plate and solid fasteners are fabricated of an aluminum material.

8. The flywheel assembly of claim 5 wherein the spacer and flat plate are fabricated of zinc.

9. The flywheel assembly of claim 1 wherein the engine flywheel is fabricated on a cast iron material.

10. The flywheel assembly of claim 1 wherein the flywheel includes a generally flat magnet structure receiving region communicating with the flywheel outer periphery, the spacer comprising a flat plate sandwiched between said region and the magnet structure.

11. The flywheel assembly of claim 1 wherein the engine flywheel includes fins for circulating air to cool the engine, the fins being positioned in an annular region near the outer periphery of the flywheel shared by the magnet structure.

12. The flywheel assembly of claim 11 wherein the angular extent of the annular region occupied by the magnet structure is substantially the same as the angular extent of the annular region occupied by the spacer.

* * * * *